United States Patent [19]

Nijman

[11] 4,048,710

[45] Sept. 20, 1977

[54] CONDUCTOR TERMINATING APPARATUS

[75] Inventor: John Peter Nijman, West Hill, Canada

[73] Assignee: Bunker Ramo Corporation, Oak Brook, Ill.

[21] Appl. No.: 738,645

[22] Filed: Nov. 4, 1976

[51] Int. Cl.[2] ..... H01R 43/04

[52] U.S. Cl. ..... 29/566.4; 29/749; 29/751; 29/753; 29/760

[58] Field of Search ..... 29/748–754, 29/760, 566.3, 566.4

[56] References Cited

U.S. PATENT DOCUMENTS

| | | | |
|---|---|---|---|
| 3,885,287 | 5/1975 | Long et al. | 29/760 X |
| 3,997,956 | 12/1976 | McKee | 29/203 MW |

*Primary Examiner*—Carl E. Hall

*Attorney, Agent, or Firm*—William Lohff; F. M. Arbuckle

[57] ABSTRACT

Apparatus is disclosed for terminating insulation covered conductors in the individual contacts of a multiple contact connector. The apparatus includes a base or connector-holding jig and an insertion tool. The base includes means for holding the connector in conductor mounting position; stationary and retractable comb elements for aligning the individual conductors with the proper contacts of the connector; and shear means. The tool includes a transverse guide portion and a longitudinal blade which form a generally T-shaped tool head. The tool head is configured to cooperate with slots formed in and by the comb elements to position the tool in proper alignment for the trimming and mounting operations.

20 Claims, 6 Drawing Figures

FIG. 3
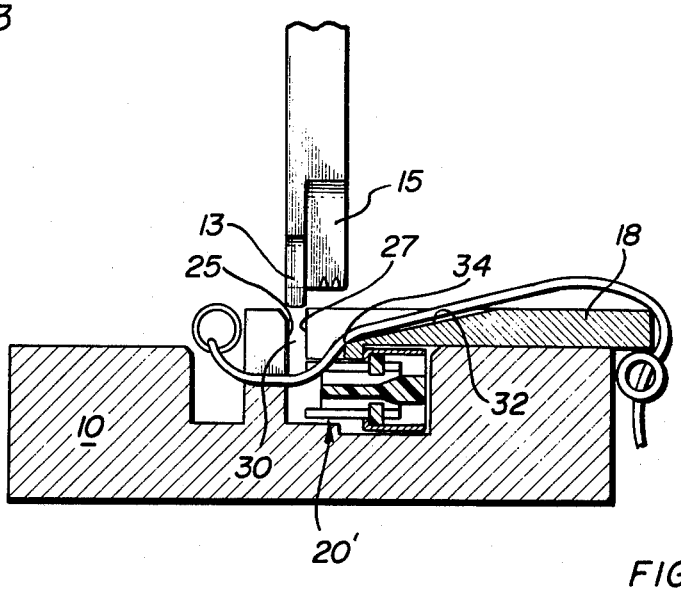
FIG. 5
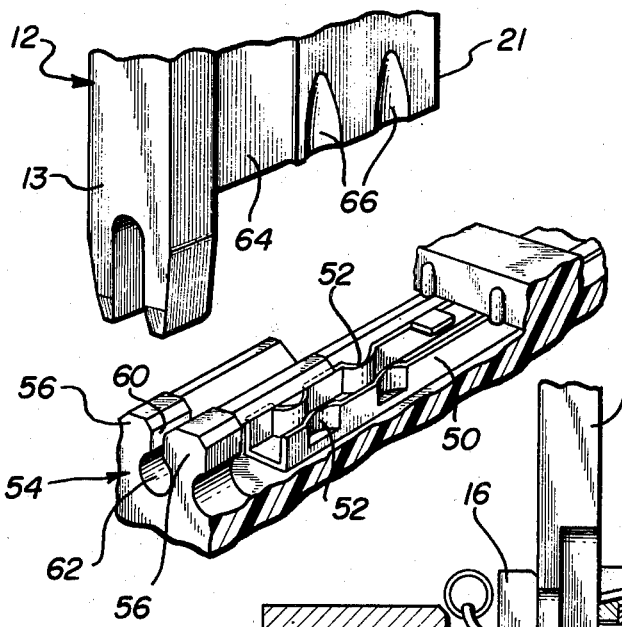
FIG. 6
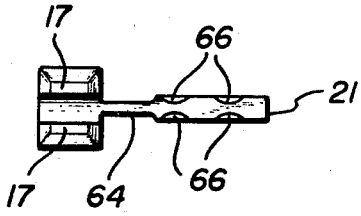
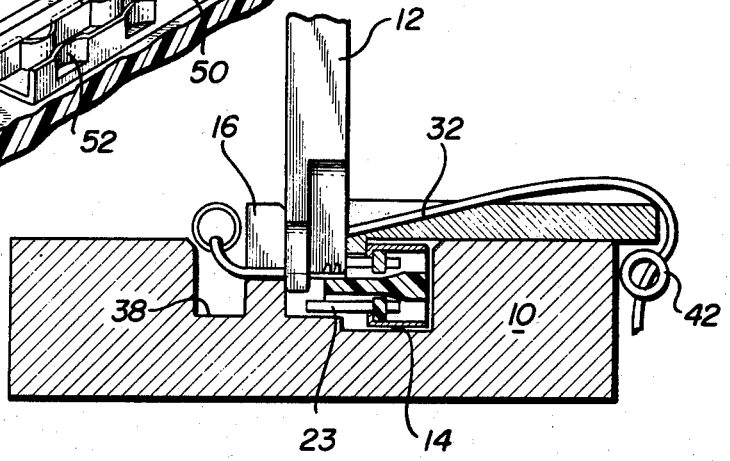
FIG. 4

CONDUCTOR TERMINATING APPARATUS

BACKGROUND OF THE INVENTION

The present invention relates to apparatus for use in terminating conductors in electrical connectors and, more particularly, to a device which facilitates the in-the-field trimming and mounting of insulation covered conductors in multiple contact electrical connectors.

With the advent of miniaturized electronics and electrical components, connectors used in the electrical, communication and data handling industries have been reduced in size, making it more difficult to connect the individual conductors with the appropriate electrical terminal of the connector. Accordingly, a wide variety of tools and mechanical devices have been developed in recent years directed at simplifying and expediting the assembly or mounting of conductors in these small electrical connectors. The tools illustrated in U.S. Pat. Nos. 3,628,202, 3,742,571, 3,866,294 and 3,952,392 are typical examples of the kinds of apparatus developed to meet this need. Generally, these tools provide some mechanism whereby the insulation covered conductor is forced into the conventional insulation piercing terminals of the connector contact.

While these prior art devices have meet with some success, there are several disadvantages associated with their manufacture and use which have limited their acceptance in the industry. For example, tools which use moving parts to effect the trimming operation are generally more expensive to manufacture and are subject to failure in the field. In addition, some prior art devices require that the individual conductors be threaded through the tool in the mounting operation. This procedure is not only time consuming but also necessitates the complete trimming and mounting of each individual conductor before the next conductor may be mounted.

In those instances where a large number of conductors are to be mounted to a multiple contact connector, the possibility of error in the arrangement of the conductors is great. Therefore, it is most desirable that the conductors be properly arranged or aligned with the appropriate contacts on the connector prior to final trimming and mounting. Of course, when each conductor must be threaded through the insertion tool to effect the mounting operation, as with many prior art devices, this desirable termination sequence is not possible.

Another disadvantage associated with prior art devices is that in some instances the conductor is trimmed by shearing it between a surface of the tool and a surface on the connector. In these devices the cutting member bears directly on the connector itself. This arrangement gives rise to possible damage to the connector when excessive force is inadvertently applied to the cutting member by the user.

A further problem associated with many hand operated prior art tools is the inability to precisely locate the insertion tool relative to the contact element during the termination operation. When the tool is improperly located the insulation-piercing elements of the contact may be damaged, resulting in poor connection and, perhaps, the need to rewire all the conductors to a new connector.

SUMMARY OF THE INVENTION

Accordingly, the present invention is directed to an improved apparatus for use in mounting conductors to a multiple contact electrical connector wherein each of the conductors may be aligned with its respective contact prior to final trimming and insertion of the conductors. The apparatus is also simply designed with few moving parts, thereby improving field reliability and minimizing the cost of manufacture. In addition, the apparatus provides for positive and precise location of the insertion tool relative to each contact of the connector and includes locating means and shear means for insertion and trimming the conductors which are remote from the connector itself. Thus, the major disadvantages associated with prior art devices are eliminated. The present invention also provides a simple and expeditious method of mounting conductors which may be properly practiced even by unskilled labor.

In accordance with one embodiment of the invention the apparatus comprises a base or connector-holding jig and an insertion tool. The base includes means for holding a suitable multiple contact connector, stationary and retractable comb elements having comb teeth which define conductor receiving slots, and stationary shear means. The insertion tool has a generally T-shaped head including a transverse guide portion and a longitudinal blade. The guide portion of the insertion tool cooperates with a cross slot formed by the two comb elements of the base, and the longitudinal blade of the tool cooperates with the slots in the retractable comb element to position the insertion tool with each conductor and a single contact member in proper alignment for the termination operation.

BRIEF DESCRIPTION OF THE DRAWINGS

The novel features which are believed to be characteristic of the present invention are set forth with particularly in the appended claims. The invention itself, however, together with further objects, attendant advantages and the mode and method of its operation will be best understood by reference to the following detailed description taken in connection with the accompanying drawings, in which:

FIG. 3 is a cross-sectional view of the embodiment as shown in FIG. 2 with the insertion tool moved into position for the trimming and mounting operations and showing in greater detail the manner in which a conductor is threaded through the apparatus;

FIG. 4 is cross-sectional view similar to that of FIG. 3 with the insertion tool in final position after the trimming and mounting operations have been performed;

FIG. 5 is an enlarged perspective view, in partial cross-section, illustrating in greater detail the relationship of the insertion tool with a typical contact of a conventional connector; and FIG. 6 is an end view of the insertion tool illustrating the T-shaped head of the insertion tool.

DETAILED DESCRIPTION OF THE PREFERRED EMBODIMENT

Figure 1:
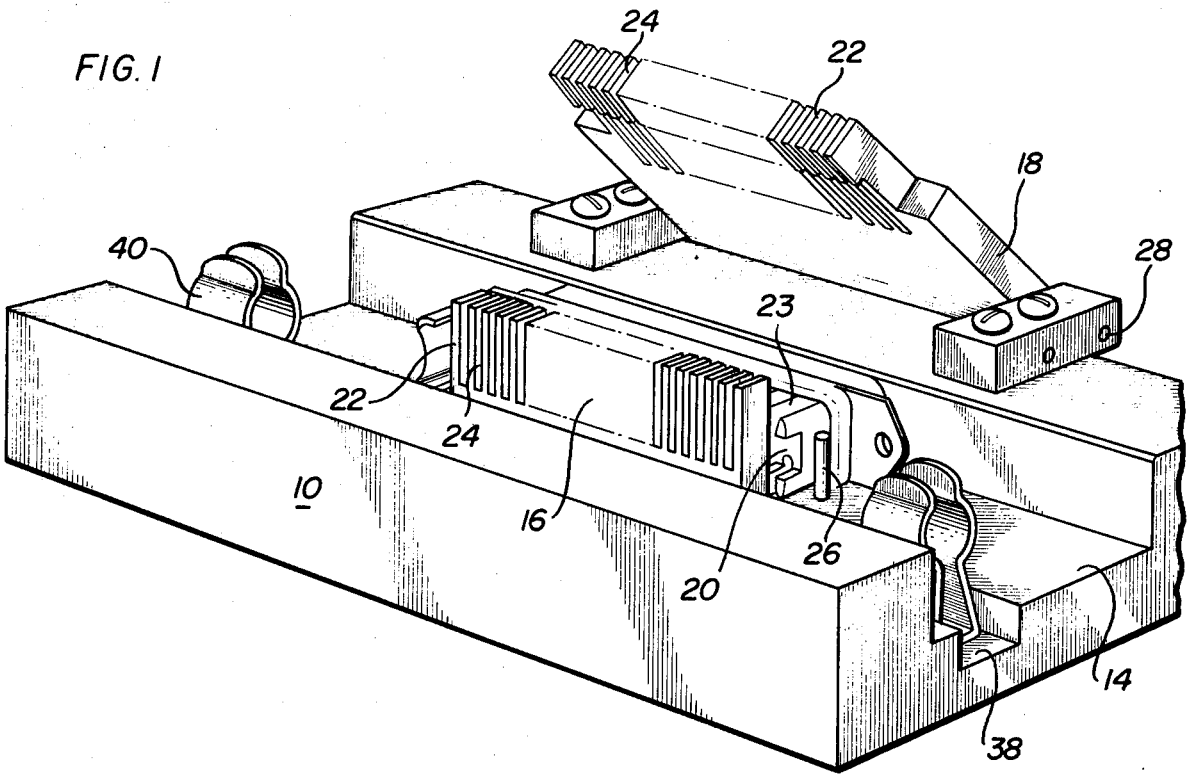
FIG. 1 is a perspective view illustrating the base of a preferred embodiment of the invention with the retractable comb element in the open position.
Figure 2:
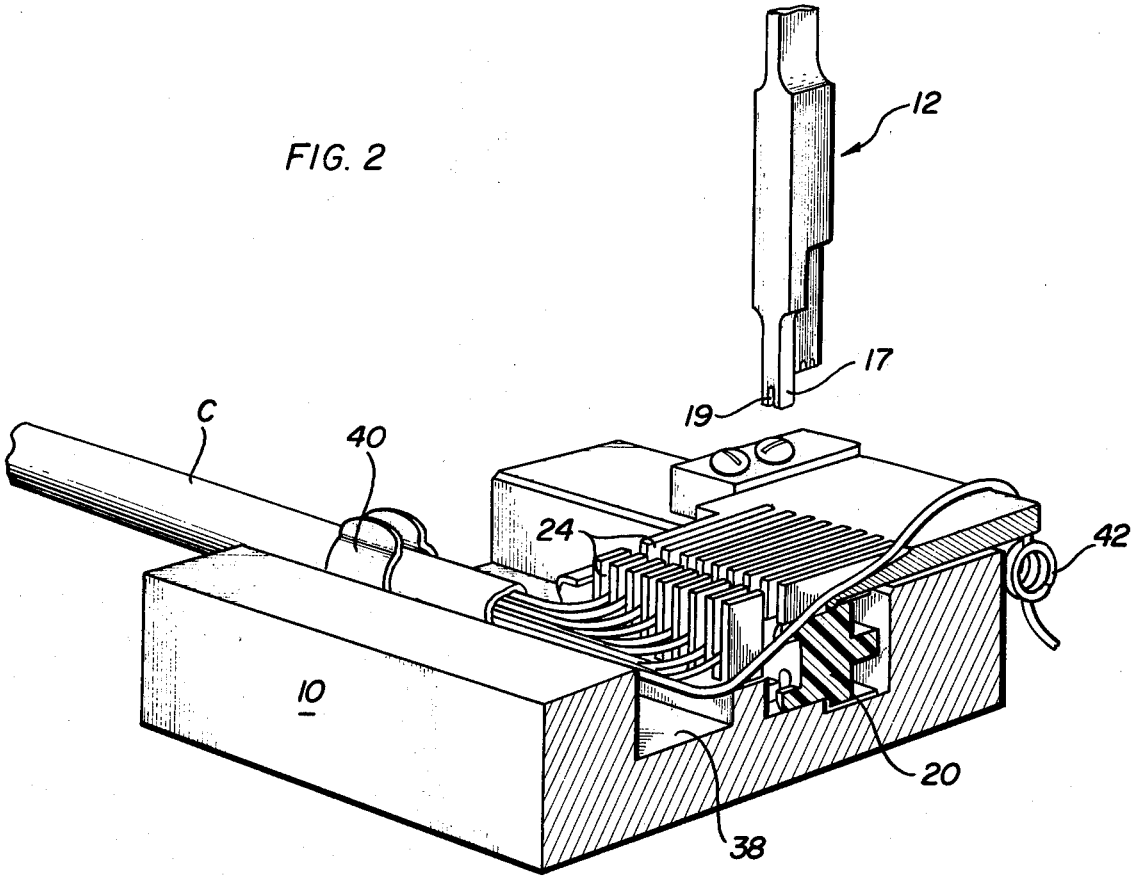
FIG. 2 is also a perspective view illustrating a preferred embodiment of the invention with individual conductors assembled in position for mounting to a multiple contact connector.

Referring now to FIGS. 1 and 2, the apparatus of the present invention is shown to comprise a base 10 and an insertion tool 12. The base 10 includes an elongated channel or cavity 14 formed to receive a multiple contact electrical connector 20, a stationary comb element 16 and a retractable comb element 18. Each of the comb elements, 16 and 18, includes comb teeth 22 which define, respectively, first and second sets of conductor receiving slots 24 positioned so as to align with the series of contact elements 23 in the connector 20.

The stationary comb element 16 includes a surface 25 which forms a lateral wall of the cavity 14, and the retractable comb element 18 forms a closure structure which is pivotally secured to the base 10 by means of pins 28. The cavity 14 is shaped and dimensioned to receive the connector 20 such that the contact bearing portion 20' of the connector terminates at a point separated from the comb element 16, as shown in FIG. 3. Means are also provided to positively locate the connector longitudinally within the cavity 14. For example, pins 26 may be employed, although other suitable locating means will be readily apparent to those skilled in the art.

The retractable comb element 18 is rotatable between the open position shown in FIG. 1 and the closed position shown in FIG. 2 whereby the connector is secured in the conductor mounting position. As can best be seen in FIG. 3, the comb element 18, in the closed position, also terminates in a surface 27 spaced from the stationary comb element 16. The resulting cross slot 30 formed by the surfaces 25 and 26 is generally transverse to the conductor receiving slots 24.

The base 10 also includes stationary shear means remote or separate from the connector which assist in the trimming operation performed with the apparatus of the present invention. In the preferred embodiment, the second conductor receiving slots 24 of the retractable comb element 18 each includes a bottom wall 32 which terminates at an edge 34 to form the shear means.

In the context of the present invention the term "stationary" when used in conjunction with the term "shear means" is intended only to mean that the particular structure does not move during the trimming operation. Thus, as will become apparent from a reading of the entire disclosure, the shear edge 34 of the illustrated embodiment does not move as the conductor is terminated.

As can be seen in FIGS. 3 and 4, the bottom wall 32 terminates at a point intermediate each conductor receiving slot 24 such that the conductor is trimmed to a length suitable for mounting in the connector 20. It is also preferred that the bottom wall 32 be inclined, extending upwardly and away from the edge 34.

The base 10 also includes a channel 38 located adjacent to the stationary comb element 16. The channel 38 extends the entire length of the base 10 and houses, at opposite ends, means for removably securing a cable or bundle of electrical conductors. In the illustrated embodiment, spring clamps 40 are employed; however, other equivalent securing means may also be used. In addition, means are provided for securing the free ends of the conductors after each has been threaded through the appropriate conductor receiving slots 24. For example, a closed-coil spring 42 may be employed for this purpose and mounted, as shown in FIG. 2, adjacent the pivoted end of retractable comb element 18.

In accordance with the preferred embodiment, an insertion tool 12 is used in conjunction with the base 10 described hereinabove. The tool 12 includes a generally T-shaped head having a transverse guide portion 13 and a longitudinal blade 15. The guide portion 13 is dimensioned to slidably engage the cross slot 30 and includes a pair of depending tines 17 which form a guide recess 19. The blade 15 is dimensioned to slidably engage the slots 24 of the retractable comb element 18 and may be specifically configured to accommodate the specific dimensions and geometrical arrangement of the contacts 23 used in the conventional electrical connector 20. In addition, blade 15 includes an edge 21 which operates, in conjunction with edge 34 of the comb element 18, to effect the trimming of the conductor. Of course, the insertion tool 12 may be provided with a handle (not shown), if the device is to be hand operated, or some other force transmitting member.

One of the important advantages of the present invention is its capability of precisely locating the insertion tool with respect to the connector, such that the blade 15 mates with the contact 23 in the proper manner. The need for precise alignment is made apparent in FIG. 5 which illustrates a typical structural configuration for the contact of a conventional connector with the tool 12 in position for termination of a conductor. The contact 23 includes an elongated channel 50 constructed from an electrically conductive material such as copper. The channel 50 has longitudinally spaced insulation piercing terminals formed by pairs of inwardly directed members 52. In addition, the connector may also employ a strain relief mechanism 54 having a pair of spaced and resilient arms 56 which define a conductor receiving passage 60 leading to bore 62. This contact structure is described in greater detail in U.S. Pat. No. 3,866,294 the disclosure of which is incorporated herein by reference. In order for the conductor to be completely seated within contact 23 and strain relief mechanism 54 it is necessary that the longitudinal blade 15 of the tool 12 be configured to accommodate the dimensions and geometrical arrangement of channel 50 and arms 56. Therefore, the blade includes a narrow portion 64 which cooperates with passage 60 and two pairs of intermediate recesses 66 which mate with members 52.

It will be appreciated by those skilled in the art that the interaction of cross slot 30 and the transverse guide portion 13 of the tool 12 insures that each of the recesses 66 is precisely aligned with members 52 and that the narrow portion 65 of the blade 15 properly mates with passage 60. Thus, the present invention eliminates the possibility of damage to the connector resulting from misalignment of the insertion tool.

In the operation of the present invention an electrical connector 20 is placed in cavity 14, and the retractable comb element 18 is moved to the closed position. A multiple conductor cable C is then clamped into position as shown in FIG. 2, and the individual insulation covered conductors are threaded through the appropriate first and second conductor receiving slots 24 in both the stationary and retractable comb elements, 16 and 18, respectively. In each instance the free ends of the individual conductors are secured between the coils of the spring 42. After the conductors have been threaded and aligned with the appropriate contacts of the connection 20, the insertion tool 12 is aligned with the cross slot 30 and a single conductor receiving slot 24. As the tool 12 is moved downward the individual conductor mates with the recess 19, and blade 15 engages the conductor, trimming it between shear edges 21 and 34. Further downward movement of the tool 12 forces the conductor into the insulation piercing terminals of the contact 23 thereby assuring a proper electrical connection. After each of the conductors has been mounted on the first side of the connector 20, the comb element 18 is opened and the connector 20 is removed and replaced with its second row of contacts 23 facing upward. The comb element 18 is then closed again and the process repeated.

From the foregoing it will be appreciated that the present invention provides a simple device which enables the facile trimming and mounting of conductors to the conventional multiple contact connector. The base 10 described hereinabove may be fabricated from metal or plastic or any other suitable material so long as the shearing edge 34 is properly hardened to insure effective trimming.

Of course, modifications and changes in the described preferred embodiment will be apparent to those skilled in the art without departing from the spirit and scope of the present invention and without diminishing its attendant advantages. Such modifications and changes are intended to fall within the scope of the following claims.

I claim:

1. Apparatus for terminating conductors in the contacts of an electrical connector, said connector having a plurality of contacts arranged therein in at least one row, said apparatus comprising:

a base having means for holding said connector in conductor receiving position;

a stationary comb element having comb teeth defining first conductor receiving slots alignable with said contacts of said connector;

a retractable comb element movable between open and closed positions and having comb teeth defining second conductor receiving slots alignable with said contacts of said connector, said retractable comb element in the closed position forming in cooperation with said stationary comb element a cross generally transverse to said conductor receiving slots;

stationary shear means positioned within each said second conductor receiving slot; and an insertion tool having a transverse guide portion for sliding within said cross slot and longitudinal blade means for inserting a conductor threaded through said comb elements into one of said contacts, said blade means also having an edge which cooperates with said stationary shear means to trim the conductor immediately prior to insertion into a contact of said connector.

2. The apparatus of claim 1 wherein each said second conductor receiving slot includes an inclined bottom wall which terminates in a cutting edge at an intermediate point within said slot, thereby forming said stationary shear means.

3. The apparatus of claim 1 wherein said retractable comb element is pivotally mounted on said base.

4. The apparatus of claim 1 wherein said base includes a connector receiving cavity and said retractable comb element is pivotally mounted on said base to provide a closure for said cavity.

5. The apparatus of claim 1 further including means to secure the free end of a conductor threaded through said comb elements.

6. The apparatus of claim 1 further including means for removably securing a plurality of conductors adjacent said stationary guide means.

7. The apparatus of claim 1 wherein said transverse guide portion of said insertion tool includes a pair of depending tines forming a guide recess aligned with said blade means.

8. Apparatus for trimming and mounting conductors in the contacts of a multi-contact electrical connector, comprising:

a base having a cavity for holding the connector in the conductor mounting position;

a stationary comb element secured to said base having comb teeth defining a first set of conductor receiving slots alignable with the contacts of said connector;

a retractable comb element pivotally connected to said base and movable to open or close said cavity, said retractable comb element having comb teeth defining a second set of conductor receiving slots alignable with the contacts of said connector and including stationary shear means, said retractable comb element in the closed position being spaced from the stationary guide means to form a cross slot generally transverse to said conductor receiving slots; and an insertion tool having a transverse guide portion and a longitudinal blade portion together forming a generally T-shaped tool head, said guide portion cooperating with said cross slot and said blade portion cooperating with the conductor receiving slots of said retractable comb element thereby properly aligning said tool for mounting said conductors in said contacts, and said blade portion also having and edge cooperating with said stationary shear means to trim each conductor immediately prior to insertion into a contact of said connector.

9. The apparatus of claim 8 wherein the conductor receiving slots of said retractable comb element each includes a bottom wall which terminates in a cutting edge at an intermedite point thereof to form said stationary shear means.

10. Apparatus for use in mounting conductors in the contacts of an electrical connector wherein each conductor is engaged and pressed into insulation piercing terminals of an individual contact by an insertion tool having a transverse guide portion and a longitudinal blade, said apparatus comprising:

a base having means for holding the connector in the conductor mounting position;

a stationary comb element secured to said base having comb teeth defining first conductor receiving slots alignable with the contacts of said connector;

a retractable comb element pivotally connected to said base and movable to open or close said cavity, said retractable comb element having comb teeth defining second conductor receiving slots alignable with the contacts of said connector, and said retractable comb element in the closed position being spaced from the stationary guide means to form a cross slot generally transverse to said conductor receiving slots;

said second slots cooperating with the tool blade and said cross slot cooperating with the transverse guide portion of said tool thereby properly aligning said tool for mounting said conductors in said contacts; and stationary shear means disposed within said retractable comb element and cooperating with an edge of said tool blade to trim each conductor as it is inserted into a contact of said connector.

11. Apparatus for terminating conductors in the contacts of an electrical connector, said connector having a plurality of elongated contacts with at least one insulation piercing terminal therein, said apparatus comprising:

a base having means for holding said connector in conductor receiving position;

a stationary comb element having a first guide surface and comb teeth defining first conductor receiving slots alignable with said contacts of said connector;

a retractable comb element movable between open and closed positions and having a second guide surface and comb teeth defining first conductor receiving slots alignable with said contacts of said connector;

stationary shear means positioned within each said second conductor receiving slot; and an insertion tool having a transverse guide portion and longitudinal blade means, said blade means having an intermediate portion configured to cooperate with said contact terminal and an edge portion which cooperates with said stationary shear means to trim the conductor immediately prior to insertion into the contact, and said transverse guide portion engaging said first and second guide surfaces to align the intermediate portion of said blade with said contact terminal and the edge portion of said blade with said shear means.

12. The apparatus of claim 11 wherein each said second conductor receiving slot includes an inclined bottom wall which terminates in a cutting edge at an intermediate point within said slot, thereby forming said stationary shear means.

13. The apparatus of claim 11 wherein said retractable comb element is pivotally mounted on said base.

14. The apparatus of claim 11 wherein said base includes a connector receiving cavity and said retractable comb element is pivotally mounted on said base to provide a closure for said cavity.

15. Apparatus for use in mounting conductors in the contacts of an electrical connector wherein each conductor is engaged and pressed into insulation piercing terminals of an individual contact by an insertion tool having a transverse guide portion and a longitudinal blade, said apparatus comprising:

a base having means for holding the connector in the conductor mounting position;

a stationary comb element secured to said base having a first guide surface and comb teeth defining first conductor receiving slots alignable with the contacts of said connector;

a retractable comb element pivotally connected to said base and movable to open or close said cavity, said retractable comb element having a second guide surface and comb teeth defining second conductor receiving slots alignable with the contacts of said connector, said second guide surface and said firt guide surface together forming a cross slot generally transverse to said conductor receiving slots;

said second slots cooperating with the tool blade and said cross slot cooperating with the transverse guide portion of said tool thereby properly aligning said tool blade both laterally and longitudinally for mounting said conductors in said contacts; and stationary shear means disposed within said retractable comb element and cooperating with an edge of said tool blade to trim each conductor as it is inserted into a contact of said connector.

16. Apparatus for use in mounting conductors in the contacts of an electrical connector wherein each conductor is engaged and pressed into insulation piercing terminals of an individual contact by an insertion tool having a tool heat including a transverse guide portion and a longitudinal blade, said apparatus comprising:

a base;

means for holding the connector in a conductor mounting position;

a comb element having comb teeth defining conductor receiving slots alignable with the contacts of said connector, said slots cooperating with and receiving said tool blade to laterally align said tool blade with said contacts; and guide means having first and second guide surfaces cooperating with the transverse guide portion of said tool head to longitudinally align said tool blade with said contacts.

17. The apparatus of claim 16 wherein said guide means comprises a cross slot generally transverse to said conductor receiving slots.

18. The apparatus of claim 17 further including stationary shear means remote from said connector and cooperating with an edge of said tool blade to trim each conductor as it is inserted into a contact of said connector.

19. The apparatus of claim 16 including another comb element having comb teeth defining conductor receiving slots, said two comb elements defining said guide means.

20. The apparatus of claim 16 wherein said comb element is movable between open and closed positions.

* * * * *